United States Patent [19]

Zeidman

[11] Patent Number: 4,526,460

[45] Date of Patent: Jul. 2, 1985

[54] DEVICE FOR PRESSURE FUSING IMAGES ON TO PAPER IN ELECTROSTATIC COPIES

[75] Inventor: Gordon G. Zeidman, Columbus, Ohio

[73] Assignee: Tokyo Shibaura Denki Kabushiki Kaisha, Japan

[21] Appl. No.: 545,165

[22] Filed: Oct. 25, 1983

[51] Int. Cl.[3] ..... G03G 15/00

[52] U.S. Cl. ..... 355/3 FU; 355/14 FU; 100/155 R

[58] Field of Search ..... 355/3 FU, 14 FU; 430/98; 118/114, 116; 100/158 R, 155 R, 176

[56] References Cited

U.S. PATENT DOCUMENTS

| | | | |
|---|---|---|---|
| 4,192,229 | 3/1980 | Tusunoi | 100/158 |
| 4,200,389 | 4/1980 | Matsui | 355/3 |
| 4,315,682 | 2/1982 | Parzanici | 355/3 |
| 4,324,482 | 4/1982 | Szlucha | 355/3 FU |
| 4,335,951 | 6/1982 | Scribner | 355/3 |
| 4,341,458 | 7/1982 | Glasa et al. | 355/3 FU |
| 4,363,862 | 12/1982 | Giorgini | 430/98 |
| 4,387,980 | 6/1983 | Ueno et al. | 355/3 CH |
| 4,399,341 | 8/1983 | Yasuoka | 355/3 FU X |

*Primary Examiner*—A. C. Prescott

*Attorney, Agent, or Firm*—Banner, Birch, McKie & Beckett

[57] ABSTRACT

This invention relates to a device for pressure fusing dry, powdered toner particles to a copy sheet in an electrostatic copier. The pressure fusing device comprises a rigid member against which fusing pressure can be applied and a plurality of independent, freely movable rollers for applying fusing pressure to a copy sheet. The plurality of rollers are contained in a tray-like housing which is vibrated so that the rollers bounce against a copy sheet and apply a fusing pressure to the copy sheet.

9 Claims, 2 Drawing Figures

DEVICE FOR PRESSURE FUSING IMAGES ON TO PAPER IN ELECTROSTATIC COPIES

BACKGROUND OF THE INVENTION

This invention relates to electrostatic copiers that produce an image by depositing a dry, powdered toner on paper. The invention relates specifically to a device for pressure fusing the toner image to the paper.

In most copying machines, the copying machine forms an optical image of the material to be copied which is projected onto the surface of a sensitized semi-conductor, forming an electrostatic image. A dark color, electrostatically sensitive, powdered material, called toner, is brought into contact with the sensitized semi-conductor. Toner particles adhere to the areas on the semi-conductor where an electrostatic charge is present. The toner particles, maintaining the pattern formed on the semi-conductor, then are transferred to a sheet of paper. The toner particles are bonded to the paper, forming a permanent reproduction of the material being copied.

Three basic methods have been used to bond the toner to the paper: solvent fusing, thermal fusing and pressure fusing. In addition a combination of heat and pressure have been found to be effective. Solvent fusing is least desirable because personnel can be exposed to harmful solvent vapors. Thermal fusing, or the combination of heat and pressure to fuse the toner, is the most commonly used technique. However, with any thermal based operation, power consumption and warm-up time are significant. Pressure only fusing has not been used extensively because there have been no good pressure fixable toners that will operate with plain paper at pressures less than 200 to 300 pounds per linear inch (pli). At these pressures, the size, weight and cost of the pressure applying elements become significant factors in a copying machine.

In prior art electrostatic copiers that use pressure fusing devices to fix or fuse the toner image to paper, the paper with an unfused image of loosely adhereing toner particles is passed between two parallel rolls that are pressed together. Generally, the rolls are supported at their ends on bearings. Most often, only one of the rolls is driven, the second roll being an idler roll. Usually the rolls are of equal diameter and, hence, are driven at equal surface velocities. In order to achieve essentially uniform fusing pressures along their entire length, the rolls are of relatively large diameter so that their deflection can be low.

SUMMARY OF THE INVENTION

The invention described and claimed herein overcomes the disadvantages of the prior art by using a plurality of rollers having overlapping surface contacts as pressure applying elements. According to the present invention, a pressure fixing device for a copying machine includes a rigid backing plate for providing a rigid surface against which fusing pressure can be applied in order to pressure fuse an image onto a copy sheet. A housing is provided adjacent to the rigid backing plate. The housing and rigid backing plate form a pressure fusing space through which a copy sheet passes.

The pressure fixing device of the present invention further includes a vibrating means for vibrating the housing and causing the rollers to contact the copy sheet. Preferably the vibrating means vibrates in a vertical direction thus forcing the rollers against the copy sheet which is supported by a rigid backing plate. The invention may be used in conjunction with one or more sets of pressure fusing rollers for applying a fusing pressure to the copy sheet. However, since these rollers are not the only pressure applying device, they may be of relatively small diameter and weight. In a preferred embodiment, there are two sets of pressure fusing rollers for applying a fusing pressure used in conjunction with the vibrating means of the invention. One of the sets of pressure fusing rollers is located in front of the housing and rigid backing plate for contacting the copy sheet before it passes through the nip formed by the housing and backing plate. The other of the sets of pressure fusing rollers is located behind the housing and the rigid member for contacting the copy sheet after it exits from the pressure fusing space formed by the housing and rigid member.

DESCRIPTION OF THE PREFERRED EMBODIMENT

A pressure fixing device according to one embodiment of the invention is shown generally at 110. The pressure fixing device includes a rigid member 112 for providing a rigid surface against which impact engergy by multiple rollers is used to pressure fuse an image onto a copy sheet, illustrated generally at 114.

Figure 2:
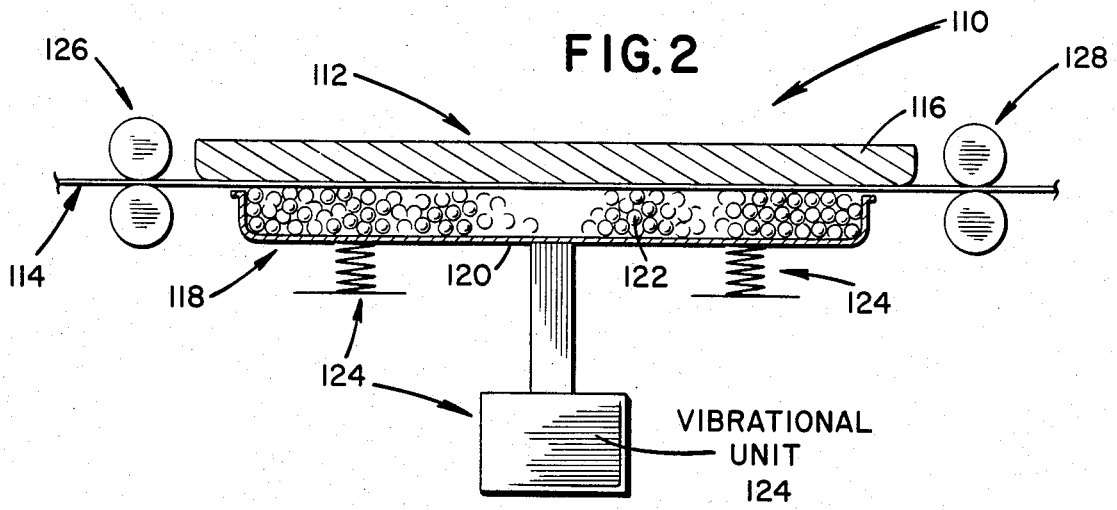
FIG. 2 is a side view schematic illustration of the pressure fixing device illustrated in FIG. 1.

Copy sheet 114 with toner applied to it passes through a pressure fusing space between rigid member 112 and housing 118. Rigid member 112 is preferably a rigid backing plate 116 which forms a firm supporting surface for copy sheet 114 as it is conveyed through pressure fixing device 110. Housing 118 in this embodiment is preferably a shallow tray 120 which forms a pressure fusing space, shown generally at 119, with backing plate 116 through which copy sheet 114 passes. A plurality of independent, freely movable rollers 122 are retained in tray 120. Preferably these rollers are small steel balls. Vibrating means 124, shown generally and schematically in FIG. 2, are provided to vibrate tray 120 vertically. Any conventional driving mechanism may be used to impart the desired vertical vibration to tray 120, such as a motor and spring element. When tray 120 is vibrated, balls 122 in tray 120 are propelled upward, strike copy sheet 114 which is in contact with backing plate 116 and fall back into tray 120 to repeat their action. The number and weight of the balls, and the frequency and amplitude of tray vibration are selected to develop sufficient energy to fuse the toner to copy sheet 114 in the area of contact and to ensure overlapping contact of the balls with the entire surface of copy sheet 14 as it passes through pressure fusing space 119.

Figure 1:
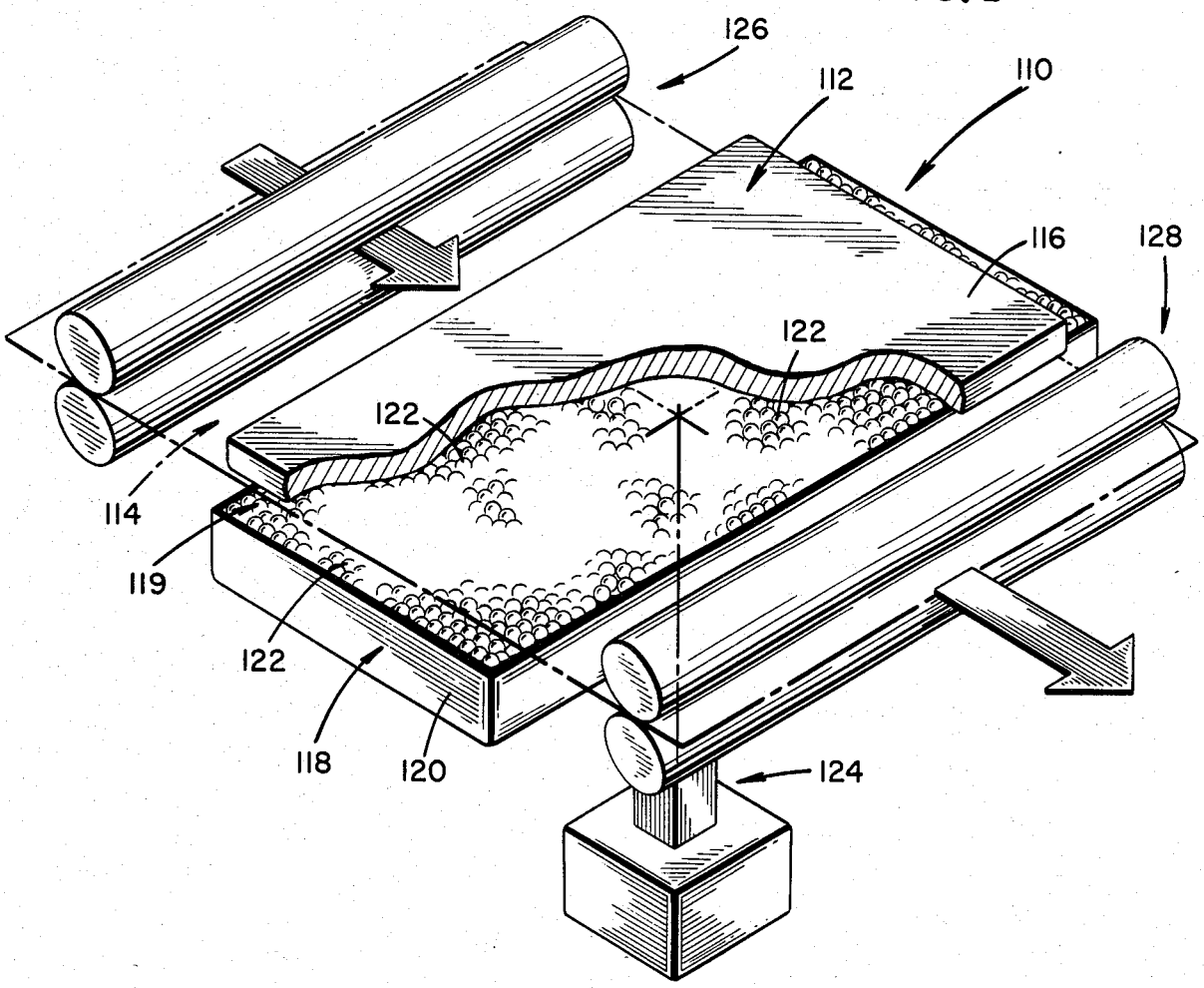
FIG. 1 is a general perspective view of a pressure fixing device according to the invention including a copy sheet being conveyed through the pressure fixing device.

The invention may also be used in conjunction with fusing rollers 126, as shown in FIG. 1. It may be desirable to pressure fuse copy sheet 114 between rollers 126 to partially fuse the image before it enters pressure fusing space 119. This will prevent any tendency for parts of the toner image to be degraded by vibration before the entire image is fused. Pressure rollers 128 may also be used after copy sheet 114 exits from pressure fusing space 119 to help fuse the toner to copy sheet 114. When rollers 126 and/or 128 are used in conjunction with pressure fixing device 110, however, they are significantly smaller and lighter than the prior art devices.

The invention eliminates the need for two large diameter, rollers in a pressure fusing device for an electrostatic copier. The elements of this invention are smaller and lighter than the rolls of a conventional device which they replace and provide for a pressure fixing device which is more compact, lighter and less costly than one based on conventional pressure roll fusing.

Although the invention has been described with respect to a particular embodiment, this is for purposes of example and illustration only. Various modifications will occur to those of ordinary skill in the art, especially with respect to size, positioning, and materials. Accordingly, the invention is intended to be limited only by the following claims.

I claim:

1. A pressure fixing device for a copying machine comprising:

a rigid backing plate for providing a rigid surface against which fusing pressure can be applied in order to pressure fuse an image onto a copy sheet;

a housing adjacent said rigid backing plate and forming a pressure fusing space with said rigid backing plate through which a copy sheet passes;

a plurality of a independent, freely movable rollers retained in said housing; and vibrating means for vibrating said housing and causing said rollers to contact the copy sheet and apply a fusing pressure to the copy sheet.

2. A pressure fixing device as recited in claim 1 wherein said vibrating means vibrate in a vertical direction.

3. A pressure fixing device as recited in claim 1 further comprising at least one set of pressure fusing rollers for applying a fusing pressure to the copy sheet.

4. A pressure fixing device as recited in claim 3 wherein there are two of said sets of pressure fusing rollers for applying a fusing pressure to the copy sheet and one of said sets of pressure fusing rollers is located in front of said housing and said rigid backing plate for contacting the copy sheet before it passes through said pressure fusing space formed by said housing and said rigid backing plate, and the other of said sets of fusing rollers is located behind said housing and said rigid backing plate for contacting the copy sheet after it exits said pressure fusing space formed by said housing and said rigid backing plate.

5. A pressure fixing device as recited in claim 1 wherein said rollers are balls.

6. In a copying machine which includes a photoconductive surface, charging means for imparting a uniform electrostatic charge to the photoconductive surface, exposure and imaging means for exposing the charged photoconductive surface to a light image of an original to be copied and forming on the photoconductive surface an electrostatic latent image of the original, developer means for developing the latent image, transfer means for transferring the developed latent image onto a copy sheet, and pressure fixing means for permanently fixing the latent image on the copy sheet, the improvement wherein said pressure fixing means comprises:

a rigid backing plate for providing a rigid surface against which fusing pressure can be applied in order to pressure fuse an image onto a copy sheet;

a housing adjacent said rigid backing plate and forming a pressure fusing space with said rigid backing plate through which a copy sheet passes;

a plurality of a independent, freely movable ball members retained in said housing; and vibrating means for vibrating said housing and causing said ball members to contact the copy sheet and apply a fusing pressure to the copy sheet.

7. A pressure fixing device as recited in claim 6 wherein said vibrating means vibrate in a vertical direction.

8. A pressure fixing device as recited in claim 6 further comprising at least one set of pressure fusing rollers for applying a fusing pressure to the copy sheet.

9. A pressure fixing device as recited in claim 8 wherein there are two of said sets of pressure fusing rollers for applying a fusing pressure to the copy sheet and one of said sets of pressure fusing rollers is located in front of said housing and said rigid backing plate for contacting the copy sheet before it passes through said pressure fusing space formed by said housing and said rigid backing plate, and the other of said sets of fusing rollers is located behind said housing and said rigid backing plate for contacting the copy sheet after it exits said pressure fusing space formed by said housing and said rigid backing plate.

* * * * *